US007775405B2

(12) United States Patent
Sweeton et al.

(10) Patent No.: US 7,775,405 B2
(45) Date of Patent: Aug. 17, 2010

(54) SPRAYER INCLUDING PRESSURE BUILD-UP DISCHARGE VALVE ASSEMBLY WITH POPPET VALVE HAVING INTEGRATED SPRING

(75) Inventors: Steve L. Sweeton, Lake Winnebago, MO (US); David DeJong, Ogden, UT (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 175 days.

(21) Appl. No.: 11/615,432

(22) Filed: Dec. 22, 2006

(65) Prior Publication Data

US 2008/0149671 A1 Jun. 26, 2008

(51) Int. Cl.
*B67D 7/58* (2010.01)
*A62C 11/00* (2006.01)

(52) U.S. Cl. ..... 222/341; 222/380; 222/383.1; 239/333; 137/540

(58) Field of Classification Search ..... 222/321.1, 222/31.7, 321.8, 321.9, 380, 383.1, 383.3, 222/336, 372, 631, 282, 300, 305, 310, 323, 222/335, 341, 373, 378, 207; 239/333, 337; 267/164, 165; 137/538, 31, 540
See application file for complete search history.

(56) References Cited

U.S. PATENT DOCUMENTS 1,322,638 A * 11/1919 Smolensky ..... 137/540
3,284,842 A * 11/1966 Jennings, Jr. ..... 16/386
4,153,203 A 5/1979 Tada
4,230,277 A * 10/1980 Tada ..... 239/333
4,273,290 A 6/1981 Quinn
4,815,663 A * 3/1989 Tada ..... 239/333
4,958,754 A 9/1990 Dennis
4,989,790 A 2/1991 Martin et al.
5,234,166 A 8/1993 Foster et al.
5,294,025 A * 3/1994 Foster ..... 222/383.1
5,337,928 A * 8/1994 Foster et al. ..... 222/383.1
5,344,053 A 9/1994 Foster et al.
5,462,209 A 10/1995 Foster et al.
5,467,901 A * 11/1995 Foster et al. ..... 222/376

(Continued)

FOREIGN PATENT DOCUMENTS

EP 0202380 * 10/1985 ..... 239/333

(Continued)

OTHER PUBLICATIONS

International Search Report WO2008079736, published May 19, 2008.

(Continued)

*Primary Examiner*—Kevin P Shaver
*Assistant Examiner*—Stephanie E Tyler
(74) *Attorney, Agent, or Firm*—MWV Intellectual Property Group

(57) ABSTRACT

A sprayer includes a discharge valve assembly and includes an integrated poppet valve, spring and volume reducer. The spring includes more than omega-shaped form, each with relatively flat sides. The spring can have sides with portions sufficiently wide to substantially extend across the valve chamber to provide stability to the spring and prevent buckling. The flat sided omega-form construct is relatively easy to manufacture via molding and the ends of such construction provide suitable locations for integrated molding with the valve and the volume reducer.

19 Claims, 4 Drawing Sheets

U.S. PATENT DOCUMENTS

| | | | | | |
|---|---|---|---|---|---|
| 5,507,437 | A | * | 4/1996 | Foster et al. | 239/333 |
| 5,522,547 | A | | 6/1996 | Dobbs et al. | |
| 5,628,461 | A | | 5/1997 | Foster et al. | |
| 5,716,008 | A | | 2/1998 | Nottingham et al. | |
| 5,873,385 | A | * | 2/1999 | Bloom et al. | 137/543.19 |
| 6,036,112 | A | | 3/2000 | Hunsicker | |
| 6,131,820 | A | | 10/2000 | Dodd | |

FOREIGN PATENT DOCUMENTS

| | | |
|---|---|---|
| EP | 0598237 A2 | 5/1994 |

OTHER PUBLICATIONS

Supplemental EP Search Report EP07855155, published Dec. 10, 2009.

* cited by examiner

SPRAYER INCLUDING PRESSURE BUILD-UP DISCHARGE VALVE ASSEMBLY WITH POPPET VALVE HAVING INTEGRATED SPRING

BACKGROUND OF THE INVENTION

1. Field of the Invention

This invention relates broadly to pump sprayers preferably of the trigger-actuated hand-operated type. More particularly, this invention relates to the pressure build-up discharge assembly, and spring biased valve therefor, located at the fluid discharge nozzle end of such sprayers.

2. State of the Art

Many known pump sprayers have discharge valves at the nozzle end of the discharge passage for throttle valving the fluid pressure during pumping. The discharge valve forms part of an assembly including a spinner probe having spin mechanics of some type to effect a spinning or swirling action of the pressurized fluid to produce a spray discharge out of the orifice. Resilient means in the form of a separate coil spring or an integral plastic molded spring is provided for urging the valve onto its seat into a closed position. The valve opens in response to fluid pressure in the discharge passage which exceeds the closing force of the spring.

Such known sprayer discharge valves are typically of the throttling type, permitting the operator to control the actuation rate of the trigger sprayer, and such actuation rate determining the flow velocity. The flow velocity through the spin mechanics determines the size of the spray plume or more precisely the rotational velocity of the annular fluid sheet exiting from the orifice. The greater the velocity (the more energy in the spray plume) the thinner the annular sheet and the finer the particles created by breakup in the atmosphere. Thus the operator's pumping stroke rate varies the size and distribution range of the spray particles.

New product formulations require a narrow distribution range of particles and a predicted mean particle size. Thus, it was desirable to effectively regulate the operator's pumping stroke velocity and thereby produce a well-defined particle size and distribution range of fluid issuing from the discharge orifice as a fine mist spray.

Co-owned U.S. Pat. No. 5,522,547 to Dobbs, the teaching of which is hereby incorporated by reference herein, achieves this objective by the provision of a two-stage pressure build-up discharge valve assembly mounted at the end of the discharge nozzle surrounded by a nozzle cap. A high pressure throttle valve incorporating a valve and coil spring is coupled with a second stage low pressure sliding piston. The two stage valve member provides a predetermined pressure threshold which when exceeded by fluid pressure generated by the operator's finger force on the trigger actuator opens immediately permitting the fluid pressure to act upon the low pressure secondary piston abruptly snapping the valve assembly to a fully open flow position. At such position the operator's fingers are effectively caused to travel all or through most of the pump actuation stroke distance before the finger muscles can compensate and adjust to the lower force permitted by the second stage piston. However, when the finger muscles adjust to the lower actuation force and relax, the coil spring abruptly snaps the two-stage valve closed at a predetermined pressure.

At both the beginning of the pumping pressure stroke and at the end of pumping actuation, the two-stage valve snaps open and snaps closed immediately thereby eliminating the formation of large droplets at the beginning and at the end of each pressure stroke, thereby resulting in a uniform, repeatable mist spray.

While the discharge valve assembly described in Dobbs functions very well, the necessity of separate valve and coil spring in the assembly described therein increases the part count. It would be desirable to integrate the valve seat, spring and piston to reduce the number of components required for the assembly.

Several patents disclose a valve, compression spring and piston integrally molded for use in discharge valve assemblies. See, e.g., U.S. Pat. No. 4,153,203 to Tada, U.S. Pat. No. 4,273,290 to Quinn, U.S. Pat. No. 4,958,754 to Dennis, U.S. Pat. No. 4,989,790 to Martin et al., U.S. Pat. No. 5,234,166 to Foster et al., and U.S. Pat. No. 5,716,008 to Nottingham et al. However, such integrated components have disadvantages when used in the discharge valve assembly of the type described in Dobbs.

For example, it is desirable for the spring in a two-stage Doobs type discharge valve assembly to have a limited repeatable throw. Wave-shaped compression springs, which are common in integrated designs, are capable of a relatively large amount of compression. Further, it is desirable for the spring to be stably held within piston chamber in a manner which prevents spring buckling. Standard wave-shaped compression springs are subject to buckling. In addition, an integrated valve, spring and piston should be easy to manufacture. Double helix spring designs like that shown in U.S. Pat. No. 5,234,166 to Foster et al. are difficult to manufacture.

SUMMARY OF THE INVENTION

It is therefore an object of the invention to provide an integrated valve and compression spring for use in a discharge valve assembly of a pump sprayer.

It is another object of the invention to provide an integrated valve and compression spring that is easy to manufacture.

It is a further object of the invention to provide a discharge valve assembly in which the compression spring therein has a limited repeatable throw.

It is also an object of the invention to provide a discharge valve assembly in which the compression spring will not buckle within the valve chamber.

In accord with these objects, which will be discussed in detail below, a trigger actuated sprayer is provided with a two-stage pressure build-up discharge valve assembly mounted at an end of a discharge nozzle. The valve assembly is provided in a valve chamber and includes an integrated poppet valve, spring and volume reducer. The volume reducer is intended to take up space within the valve chamber to reduce priming volume.

The spring includes more than one full angular omega-shaped form with relatively flat sides. The flat sides define longitudinally displaced spaces between adjacent omega-forms. Portions of the spring are preferably sufficiently wide to substantially extend across the valve chamber to provide stability to the spring and prevent buckling. The flat sided omega-form construct is relatively easy to manufacture via molding and the ends of such construction provide suitable locations for integrated molding with the valve and the volume reducer.

The valve includes an end seal cone which seats within a small hole in the valve seat of the valve assembly, and a larger poppet which seats against or near the valve seat. In addition, in accord with various embodiments of the invention, the valve may be provided with or without a chevron; i.e., a flange.

Furthermore, the relative locations of the spring and volume reducer can be interchanged. That is, the spring may be located between the valve and volume reducer, or the volume reducer may be located between the valve and spring.

The integrated valve, spring and volume reducer function to permit the valve to operate as a two stage system, as generally described in previously incorporated U.S. Pat. No. 5,522,547 to Dobbs. A predetermined high pressure threshold is initially required to move the seal cone from the valve seat. Such pressure is generated by the operator's finger force on the trigger actuator. Once the valve opens, the fluid pressure is permitted to act upon the low pressure secondary poppet snapping the valve assembly to a fully open flow position. At such position the operator's fingers are effectively caused to travel all or through most of the pump actuation stroke distance before the finger muscles can compensate and adjust to the lower force permitted by the second stage poppet. However, when the finger muscles adjust to the lower actuation force and relax, the integrated flat-sided omega-form spring abruptly snaps the two-stage valve closed at a predetermined pressure.

At both the beginning of the pumping pressure stroke and at the end of pumping actuation, the two-stage valve snaps open and snaps closed immediately thereby eliminating the formation of large droplets at the beginning and at the end of each pressure stroke, thereby resulting in a uniform, repeatable mist spray.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
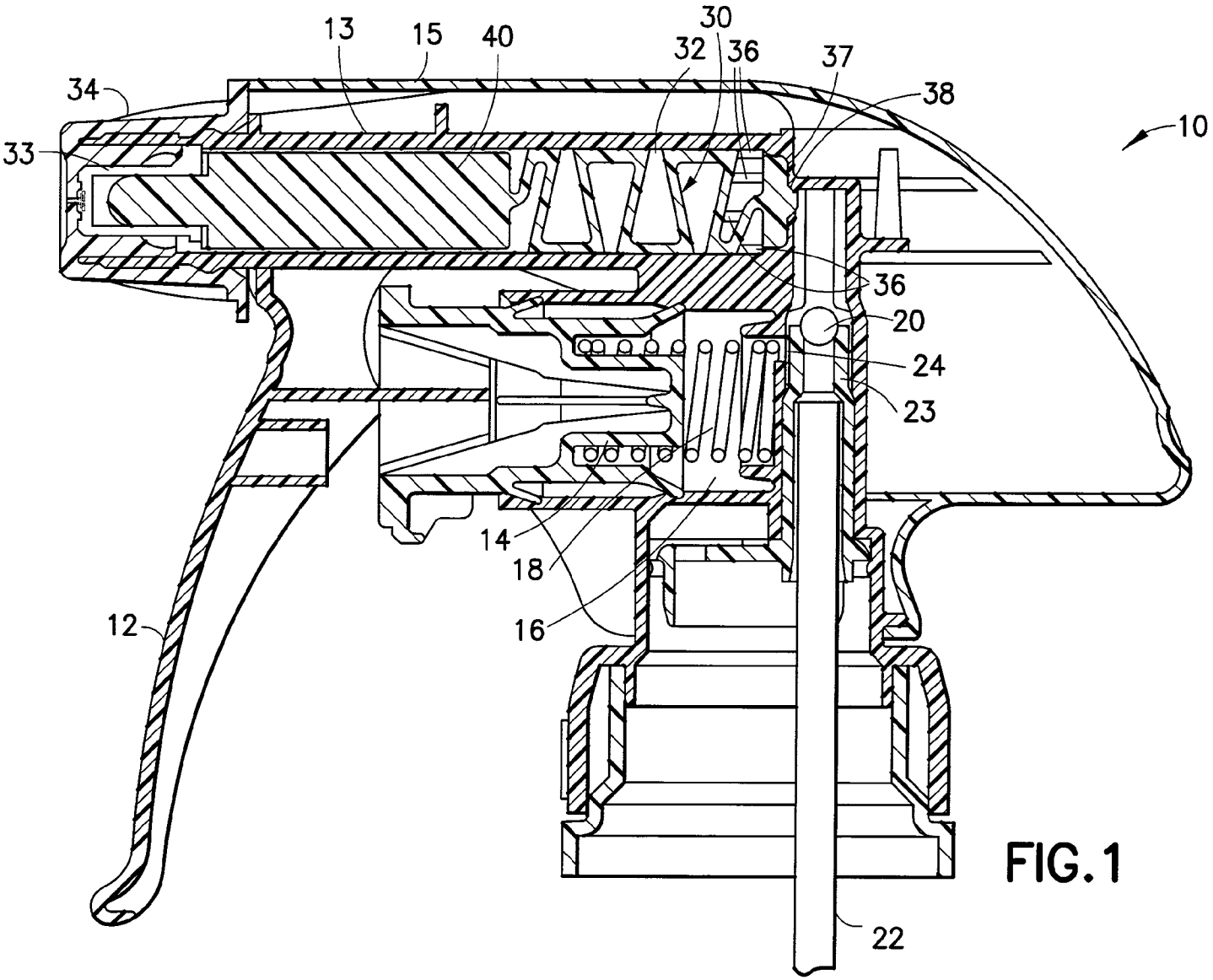
FIG. 1 is a section view through a sprayer according to the invention.

Turning now to FIG. 1, a trigger actuated sprayer 10 is shown. The sprayer 10 includes a trigger 12 coupled to a housing 13. A shroud 15 may be provided over the housing 13. Manual actuation of the trigger 12 causes reciprocation of a spring-biased pump piston 14 within a pump cylinder 16. Relative movement of the pump piston 14 and pump cylinder 16 in a first (release) direction causes expansion of a pump chamber 18 defined by the piston and cylinder. Such expansion creates negative pressure that opens a ball valve 20 and draws fluid up an intake tube 22 that extends into a container (not shown), into housing intake 23, and into the chamber 18 through an opening 24. Relative movement of the pump piston 14 and pump cylinder 16 in a second opposite (actuation) direction causes compression of the pump chamber 18, forces the fluid out of opening 24 and into a discharge valve assembly 30.

Figure 2:
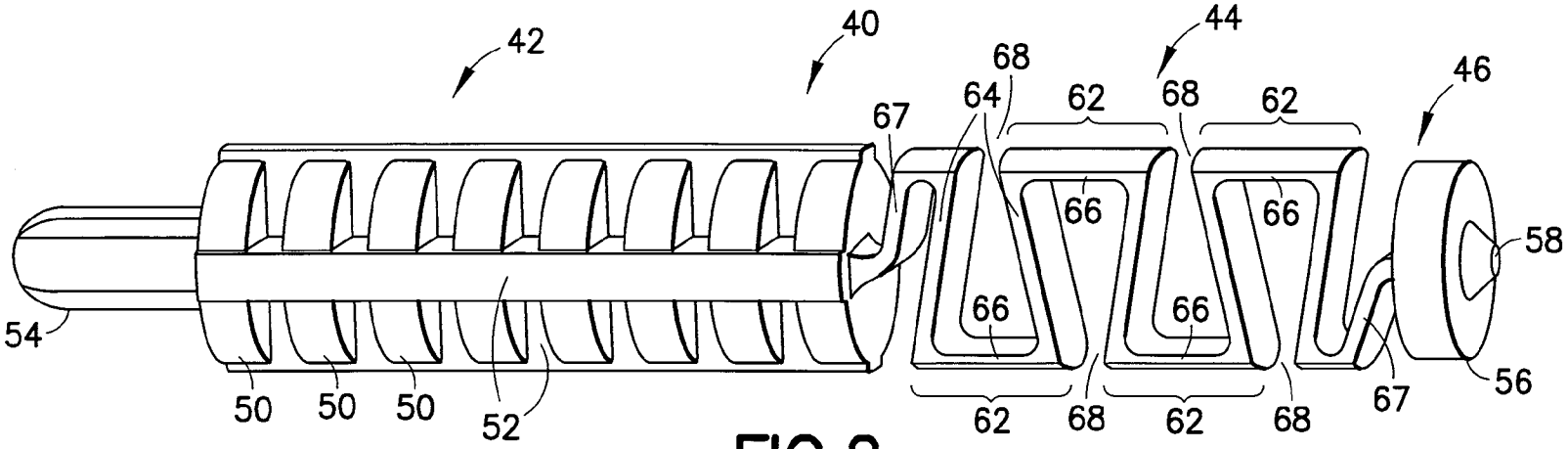
FIG. 2 is side elevation of an embodiment of an integrated valve, spring and volume reducer element according to the invention.
Figure 3:
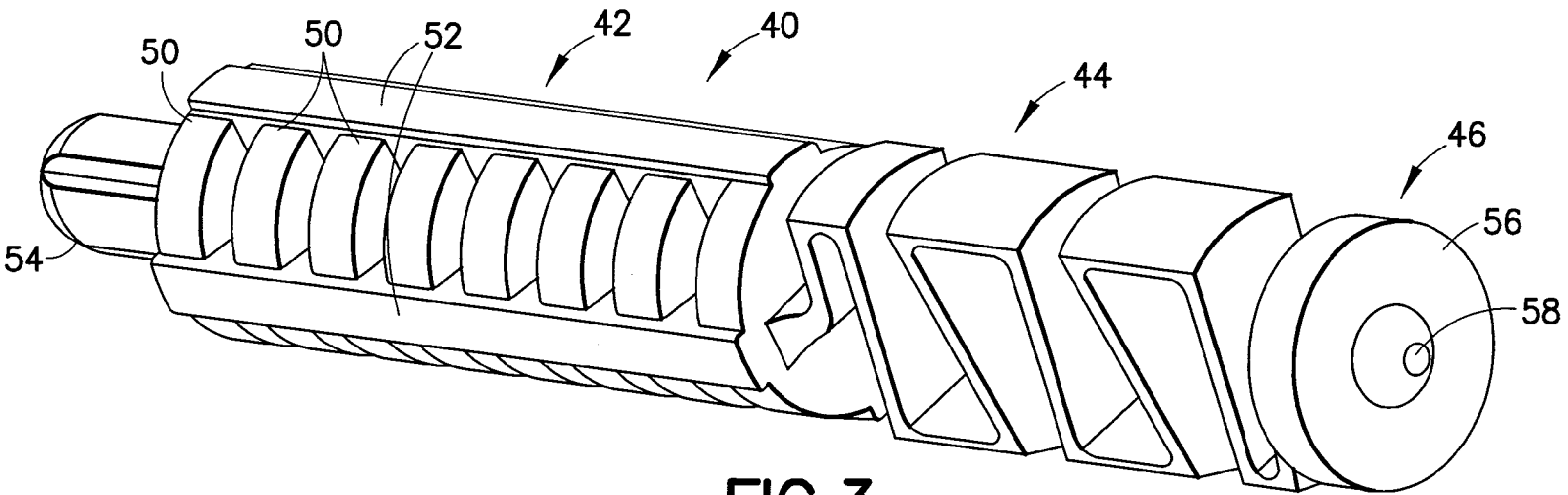
FIG. 3 is a perspective view of the element shown in FIG. 2.

Referring to FIGS. 1 through 3, the discharge valve assembly 30 is mounted in a valve chamber 32 before the discharge nozzle 33 of the sprayer, which is preferably surrounded by a nozzle cap 34. The rear of the valve chamber 32 includes several short circumferentially-spaced ridges 36 and defines a recessed valve seat 37 with a preferably central hole 38. The discharge valve assembly includes an integrally formed element 40 (e.g., by molding) that preferably comprises a volume reducer 42, spring 44 and poppet valve 46.

The volume reducer 42 operates to reduce the priming volume of the chamber 32; i.e., to reduce the number of times the trigger must be operated the first time the sprayer is used before spray is discharged from nozzle. In the embodiment shown, the volume reducer 42 is structured as a series of discs 50 displaced along a longitudinal cruciform 52. The discs 50 are smaller than the transverse dimensions of the cruciform 52 to allow fluid flow past the reducer 42 in the axial direction through the chamber 32. A nipple 54 is preferably provided to the forward end of the volume reducer 42.

Figure 4:
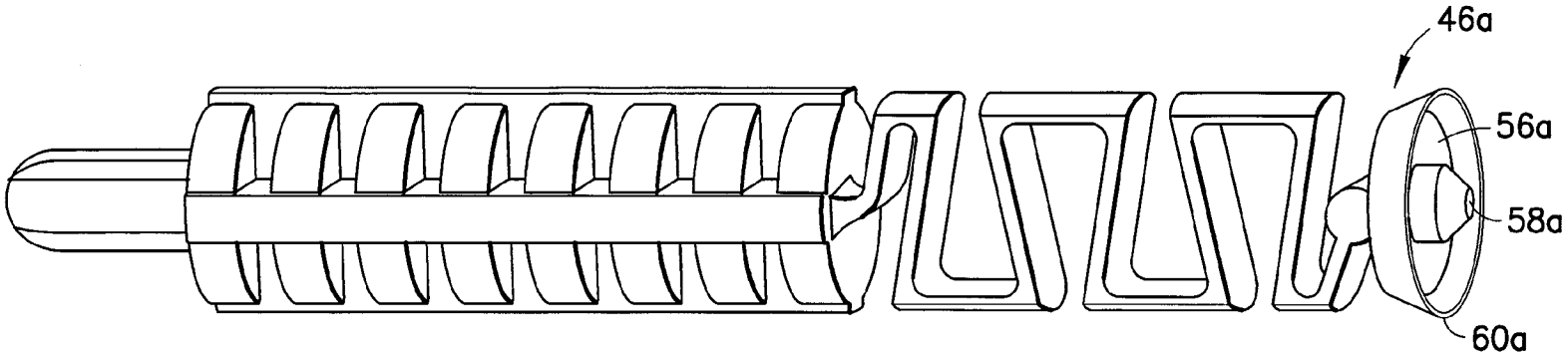
FIG. 4 is a side elevation of another embodiment of an integrated valve, spring and volume reducer element according to the invention.
Figure 5:
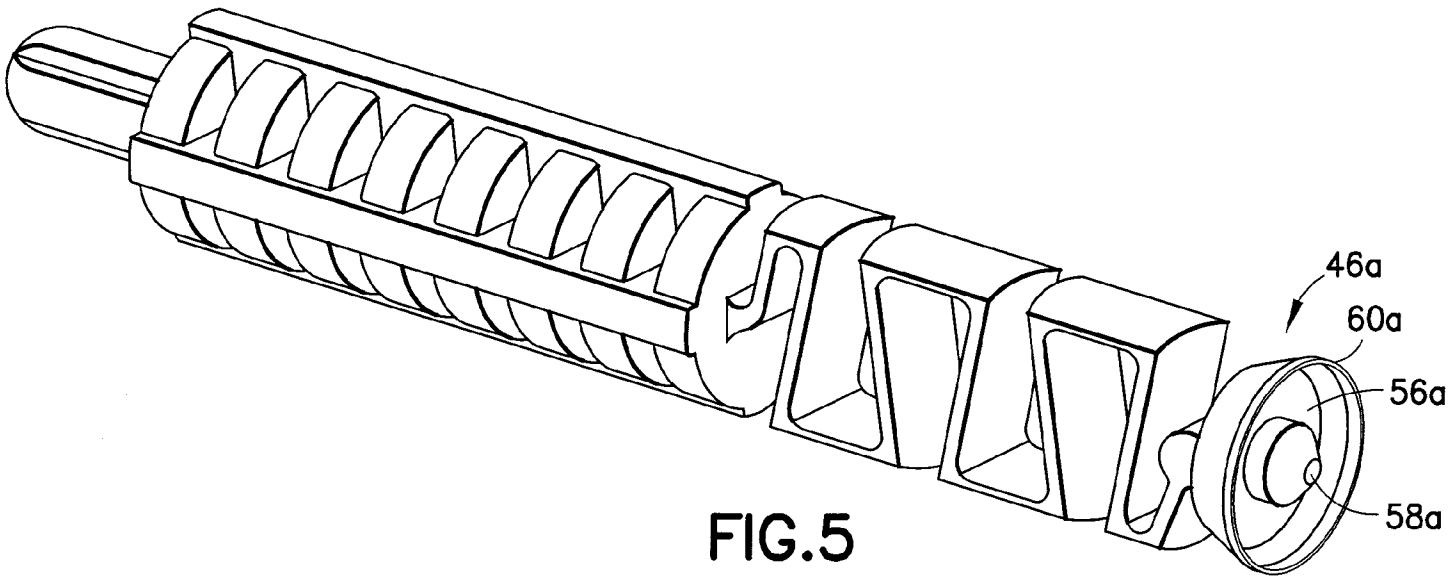
FIG. 5 is a perspective view of the element shown in FIG. 4.

The poppet valve 46 includes a flat poppet 56 and a central generally frustoconical seal cone 58 located thereon. The seal cone 58 is positioned to be centered relative to the hole 38 in the valve seat 37, and is sized so that it extends at least partially into the hole. In addition, referring to FIGS. 4 and 5, the poppet valve **46*a* optionally may be provided with a chevron (conical flange) 60*a* about the periphery poppet 56*a* and partially about the seal cone 58*a***.

Referring back to FIGS. 1 through 3, the spring 44 holds the poppet valve 46 in a closed position against or near the valve seat 37 at the rear of the valve chamber 32. The spring 44 includes more than one full angular omega-shaped form 62 with relatively flat transverse and longitudinal sides 64, 66 which are angled relative to each other. The transverse sides 64 are angled inward toward each other, e.g., at about 10° relative to perpendicular and they preferably have sufficient height to substantially fill (i.e., extend across) the valve chamber. As shown, the spring 44 includes two full omega-shaped forms and an additional half form, and leads 67. The longitudinally oriented flat sides 66 define displaced spaces 68 between the angular omega-forms 62 which are preferably less than approximately twenty percent (20%) the length of the longitudinal sides in the axial dimension of the valve chamber 32. If the spring 44 is sufficiently compressed, such longitudinal sides 62 of the omega-forms 62 could contact each other so as to eliminate the spaces between such sides. Thus, in a preferred embodiment, the maximum spring compression is at most approximately twenty percent of the length of the spring, but in practice the spring constant is such that it will not fully compress under the force of fluid compression within the pump 18. The flat sided omega-form construct of the spring 44 is relatively easy to manufacture via molding and the ends or leads 67 of such construction provide suitable locations for integrated molding with the poppet valve 46 and the volume reducer 42. As shown, the leads 67 extend approximately half the height of the valve chamber so as to transition into the poppet valve 46 and volume reducer 42 along a central axis of the valve chamber.

Figure 6:
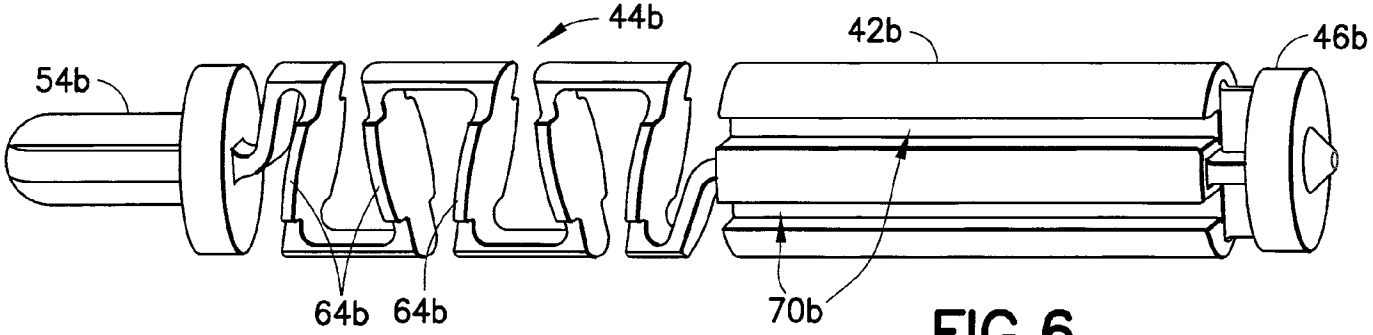
FIG. 6 is a side elevation of an additional embodiment of an integrated valve, spring and volume reducer element according to the invention.
Figure 7:
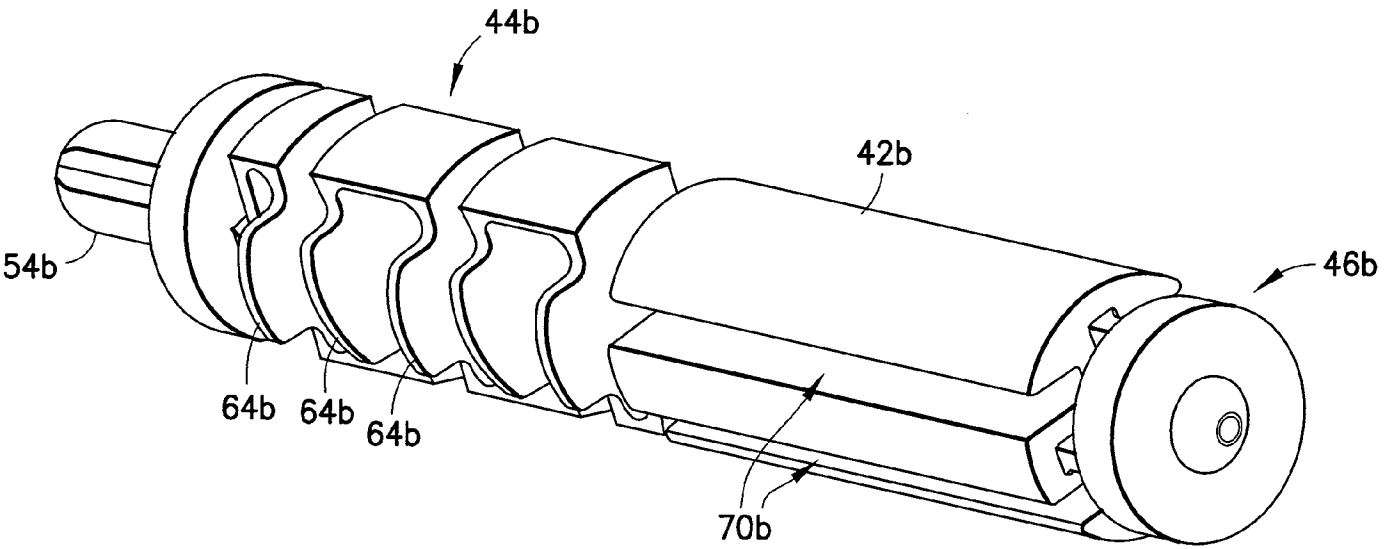
FIG. 7 is a perspective view of the element shown in FIG. 6.

The relative locations of the spring 44 and volume reducer 42 can be interchanged. That is, the spring 44 may be located between poppet valve 46 and volume reducer 42, as shown in the prior Figures, or turning to FIGS. 6 and 7 the volume reducer **42*b* may be located between the poppet valve 46*b* and spring 44*b*, with the nipple 54*b* preferably at the leading end of the spring. In addition, as shown with respect to FIGS. 6** and 7, the spring 44*b* can have one or more transverse sides 64*b* with portions sufficiently wide to substantially extend across the valve chamber 32 to further promote stability for the spring and prevent buckling. In addition, the volume reducer shown is provided with longitudinal grooves 70*b* as a fluid path past the volume reducer for the fluid with the valve chamber.

Referring back to FIG. 1, the integrated valve, spring and volume reducer element 40 allow the discharge valve assembly 30 to operate as a two stage system, generally in accord with a system of the type described in previously incorporated U.S. Pat. No. 5,522,547 to Dobbs. When the poppet valve 46 of the discharge assembly is closed relative to valve seat 37, pressure directed toward to the valve chamber 32 is first focused on the seal cone 58. In view of the small exposed surface area of seal cone 58 and the force of spring 44, a predetermined high pressure threshold is initially required to open the poppet valve 46. Initial pressure is created in the pump chamber 18 under actuation of the trigger 12 to overcome the required high pressure threshold. Once the poppet valve 46 opens, the fluid pressure is permitted to act upon the larger surface area of the low pressure secondary poppet 56, causing the poppet 56 to translate along ridges 36 and snapping the valve assembly 30 to a fully open flow position. At such position the operator's fingers are effectively caused to travel all or through most of the pump actuation stroke distance before the finger muscles can compensate and adjust to the lower force permitted by the second stage piston. However, when the finger muscles adjust to the lower actuation force and relax, the integrated flat-sided omega-form spring 44 abruptly snaps the two-stage valve 46 closed at a predetermined pressure.

At both the beginning of the pumping pressure stroke and at the end of pumping actuation, the two-stage valve 46 snaps open and closed immediately, thereby eliminating the formation of large droplets at the beginning and at the end of each pressure stroke, and resulting in a uniform, repeatable mist spray.

There have been described and illustrated herein several embodiments of a trigger sprayer, a discharge valve assembly therefor, an integrated valve, spring and volume reducer for the discharge valve, and a particular spring design. While particular embodiments of the invention have been described, it is not intended that the invention be limited thereto, as it is intended that the invention be as broad in scope as the art will allow and that the specification be read likewise. Thus, while several variations to certain embodiments of the invention have been disclosed, it is anticipated that alternative embodiments described in the specification may be interchangeably used with any other described embodiments as well. In addition, while certain exemplar size ratios have been disclosed with respect to the spring, it is appreciated that such ratios are exemplar and not meant to limit the invention disclosed herein. Also, while a spring with two and a half omega-forms has been shown, the spring could have fewer or more omega-forms, although it should have more than one full form (i.e., at least one and a half forms so as to generate at least two gaps). Furthermore, while the integrated valve, spring and volume reducer have been described with respect to a trigger actuated sprayer, it is appreciated that such component can be used in the discharge valve assembly of sprayers and even pumps actuated by other means, including but not limited to battery-powered motor-actuated means. Also, where a ball valve is disclosed as a one-way valve, it is appreciated that other one-way valve may be used including but not limited to duck-bill valves. In addition, it is recognized that a spring of the design described, apart from the integrated valve element, may have utility on its own within a discharge valve assembly or otherwise. It will therefore be appreciated by those skilled in the art that yet other modifications could be made to the provided invention without deviating from its spirit and scope as claimed.

What is claimed is:

1. A sprayer for spraying a fluid from a fluid source, comprising:

a) a compression chamber having an opening;

b) a fluid intake;

c) a one-way valve between said fluid intake and said opening in said chamber; and d) a discharge valve assembly in communication with said compression chamber, including i) a valve chamber having a rear entry, an exit, and a longitudinal axis, and ii) an element integrally formed to include a poppet valve and a spring, said poppet valve provided with a central seal cone and a chevron and biased by said spring to seat against said rear entry of said valve chamber and said spring including more than one form each having a first section extending parallel to the longitudinal axis as well as second and third sections that extend radially inward from opposed ends of the first section toward one another, wherein when said fluid intake is in fluid communication with the fluid source and said compression chamber is expanded, the one way valve opens and the fluid from the fluid source is drawn through said fluid intake and into said compression chamber through said opening, and when said compression chamber is compressed, the one way valve is closed and the fluid is forced through the discharge valve assembly and out of said exit of said valve chamber.

2. A sprayer according to claim 1, wherein:

said first, second and third sections of each form of said spring are relatively flat.

3. A sprayer according to claim 1, wherein:

said spring includes at least two longitudinally displaced forms.

4. A sprayer according to claim 1, wherein:

said spring is adapted such that spaces between adjacent first sections are each less than twenty percent of the length of the first sections.

5. A sprayer according to claim 1, wherein:

at least one of said first, second and third sections of the forms of said spring is sufficiently wide to extend substantially across said valve chamber.

6. A sprayer according to claim 5, wherein:

at least one of said second and third sections of the forms of said spring is sufficiently wide to extend substantially across said valve chamber.

7. A sprayer according to claim 1, wherein:

said element further includes a volume reducer.

8. A sprayer according to claim 7, wherein:

said spring is located between said poppet valve and said volume reducer.

9. A sprayer according to claim 7, wherein:

said volume reducer is located between said spring and said poppet valve.

10. A sprayer according to claim 7, wherein:

a leading end of said element is provided with a nipple.

11. A sprayer according to claim 7, wherein:

said volume reducer includes a cylinder provided with longitudinal ridges.

12. A sprayer according to claim 7, wherein:

said volume reducer includes a longitudinal cruciform provided with a plurality of longitudinally displaced discs.

13. A sprayer according to claim 1, further comprising:

a nozzle through which fluid is ejected after exiting said exit of said valve chamber.

14. A sprayer according to claim 1, wherein:

said compression chamber is defined by a piston cylinder interfacing to a movable piston.

15. A sprayer according to claim 14, further comprising:

a manually actuatable trigger that moves said piston relative to said piston cylinder.

16. A valve assembly comprising:

a) a valve chamber having a longitudinal axis; and b) a unitary valve element including a valve comprising a poppet provided with a chevron and a spring including more than one form each having a first section extending parallel to the longitudinal axis as well as second and third sections that extend radially inward from opposed ends of the first section toward one another, said spring molded as one piece with said valve.

17. A valve assembly according to claim 16, wherein:

said spring includes at least two longitudinally displaced forms.

18. A valve assembly according to claim 16, wherein:

said valve includes a poppet provided with a central seal cone.

19. A valve assembly according to claim 16, further comprising:

a volume reducer, wherein of said valve, said spring and said volume reducer either said spring or said volume reducer is centrally located relative to the other elements.

* * * * *